United States Patent [19]

Hanazima et al.

[11] Patent Number: 4,606,796

[45] Date of Patent: Aug. 19, 1986

[54] COLORED, ANODIZED ALUMINUM-BASE ARTICLE AND METHOD OF PREPARING SAME

[75] Inventors: Yasuhiro Hanazima; Norihiro Ogawa, both of Shizuoka; Masumi Sugioka, Shimada, all of Japan

[73] Assignee: Asahi Malleable Iron Co., Ltd., Japan

[21] Appl. No.: 736,418

[22] Filed: May 20, 1985

Related U.S. Application Data

[63] Continuation-in-part of Ser. No. 573,407, Jan. 24, 1984, abandoned.

[30] Foreign Application Priority Data

Jan. 24, 1983 [JP] Japan ..... 58-8971[U]

[51] Int. Cl.[4] ..... C25D 5/00

[52] U.S. Cl. ..... 204/42; 204/58; 204/37.6

[58] Field of Search ..... 204/42, 58, 37.6

[56] References Cited

U.S. PATENT DOCUMENTS

| | | | |
|---|---|---|---|
| 1,965,683 | 7/1934 | Work | 204/58 |
| 2,052,575 | 9/1936 | Lilienfeld | 204/42 |
| 2,888,388 | 5/1959 | Stiller | 204/37.6 |
| 2,905,600 | 9/1959 | Franklin | 204/58 |
| 3,058,855 | 10/1962 | Kirby et al. | 204/37.6 |
| 3,666,638 | 5/1972 | Harris et al. | 204/42 |

*Primary Examiner*—R. L. Andrews

*Attorney, Agent, or Firm*—Darby & Darby

[57] ABSTRACT

A colored, anodized aluminum-base article including an aluminum-base substrate, and first and second anodized aluminum oxide films overlaid thereon. The inner, second film has a hardness of about 330 Hv or more, while the outer, first film is more porous than the second film and has a hardness of about 270 Hv or less. The first film is colored with a coloring agent. The article is prepared by anodizing an aluminum-base substrate in an electrolyte bath at a temperature of 20°–40° C. and, subsequently at a temperature not higher than 10° C., the resultant substrate having two types of anodic aluminum oxide films formed thereon being subjected to a coloring treatment.

3 Claims, No Drawings

COLORED, ANODIZED ALUMINUM-BASE ARTICLE AND METHOD OF PREPARING SAME

This is a continuation-in-part, of application Ser. No. 573,407, filed Jan. 24, 1984 now abandoned and incorporated herein by reference.

BACKGROUND OF THE INVENTION

This invention relates to a colored, anodized aluminum-base article.

More specifically, the present invention is concerned with a colored, anodized aluminum-base article having two kinds of anodized aluminum oxide films overlaid on an aluminum-base substrate. The present invention is also directed to a method of preparing such an article.

It is well known in the art that aluminum or an aluminum alloy can be improved in its corrosion and weather-resistance by forming an anodized aluminum oxide film on the surface thereof. There are known several different kinds of anodic aluminum oxide film, such as so called ordinary and hard anodic oxide films. The ordinary anodic oxide film is produced by anodizing aluminum or its alloy in an electrolyte bath, such as sulfuric acid bath, at a temperature of 20°–40° C. generally under direct current conditions. This film is clear and porous and, therefore, is suited for being colored. However, the corrosion-resistance of the film is not sufficiently high because of the high porosity and a large pore diameter thereof. On the other hand, the hard anodic oxide film is prepared by the anodization of aluminum or its alloy at a temperature of not higher than 10° C. The hard film is less porous and has a greater thickness than the ordinary anodic oxide film and, hence, exhibits a high corrosion-resistance. However, the low porosity and the small pore diameter of the pores of the film make it difficult to color the hard film.

SUMMARY OF THE INVENTION

It is, therefore, the prime object of the present invention to provide a colored, anodized aluminum-base article havinq both a high resistance to corrosion and a desirable color.

In accomplishing the above object, there is provided in accordance with the present invention a colored, anodized aluminum-base article which includes an aluminum-base substrate, and first and second anodic aluminum oxide films overlaid on the substrate in this order. The second film has a thickness of between 30 and 150 μm and a Vicker's hardness number of at least about 330 Hv. The first film has a thickness of between 5 and 25 μm and a Vicker's hardness number of not greater than about 270 Hv and is colored with a coloring agent deposited within the pores thereof. The Vicker's hardness number herein is measured according to the method specified in Japanese Industrial Standard.

In another aspect, the present invention provides a method of preparing the above anodized aluminum-base article.

Other objects, features and advantages of the present invention will become apparent from the detailed description of the invention which follows.

DETAILED DESCRIPTION OF THE INVENTION

The colored, anodized aluminum-base article of the present invention is comprised of an aluminum-base substrate on which first and second anodic aluminum oxide films are overlaid.

The aluminum-base substrate includes aluminum and its alloy such as Al-Mg-Zn and Al-Mg.

The second anodic aluminum oxide film formed on the surface of the substrate is so-called "hard anodic aluminum oxide film" which is characterized by its low porosity and high hardness. The second film has a Vicker's hardness number of at least about 330 Hv, preferably between about 350 and about 450 Hv and a thickness of between 30 and 150 μm, preferably between 50 and 70 μm.

The upper, first anodic aluminum oxide film provided over the surface of the second film is so-called "ordinary anodic aluminum oxide film" which is characterized by its high porosity and clearness. The first film has a Vicker's hardness number of not greater than about 270 Hv, preferably between about 150 and about 250 Hv and a thickness of between 5 and 25 μm, preferably between 10 and 20 μm. Preferably, the first film has an average pore diameter of between about 100 and 300 A. The first film is colored by deposition of a coloring agent within at least a part of the pores thereof. Any organic and inorganic coloring agents customarily used in this field may be used in the present invention. Depending upon the kind of the metals constituting the substrate, the first film is spontaneously colored. In this case, the resultant article may acquire deep colors attributed to the coloring agent and the first film.

The colored composite aluminum-base article of the present invention is produced as follows. Aluminum or its alloy is first subjected to a first anodization treatment in a manner known per se to form thereon a second anodized aluminum oxide film having such a thickness and a hardness as described previously. More particularly, aluminum or its alloy is immersed in a first electrolyte bath such as a sulfuric acid-based electrolyte, together with a suitable counter-electrode such as an aluminum cathode. Then a voltage, generally a direct current voltage of 12–22 volts, is impressed between the opposite electrodes for a period of time so that the second anodic aluminum oxide film having a desired thickness is obtained. It is important that the first anodic oxidation treatment should be carried out at a temperature of 20°–40° C.

The aluminum having the second film formed thereon is then subjected to a second anodization treatment in a second electrolyte bath to form under the second film a first anodic aluminum oxide film having such a hardness and a thickness as described previously. The second anodization treatment is performed in a manner known per se. Sulfuric acid, oxalic acid, a mixture of sulfuric acid with oxalic acid and/or citric acid are illustrative of suitable second electrolytes. It is important that the second treatment should be carried out at a temperature not exceeding 10° C. in order that the anodic oxide film has a high hardness.

The resultant aluminum overlaid with the first and second anodic aluminum oxide films is then colored in a conventional manner such as by electrocoloring technique, and then subjected to a conventional sealing treatment.

The following examples will further illustrate the present invention.

EXAMPLE 1

An aluminum-base alloy consisting of 3.2–3.8 weight % of Mg, 2.8–3.2 weight % of Zn and balance being essentially Al was treated with a detergent for degreasing. The treated alloy was then subjected to a first anodization treatment in sulfuric acid having a $H_2SO_4$ content of 220 g/1 using graphite as the counter-electrode. The first anodization treatment was performed at a temperature of 30° C. for 10 min at a current density of 4 amperes per square decimeter, thereby forming on the alloy an ordinary anodic aluminum oxide film having a thickness of 12 μm.

The first anodization was followed by a second anodization treatment performed in the same electrolyte bath at a temperature of 2 for 40 min with stirring to form under the ordinary oxide film a hard anodic aluminum oxide film having a thickness of about 60 μm. After being washed with water, the resultant alloy was immersed in a coloring liquid containing 10 g/1 of a commercially available coloring aqent (Trademark: SANODAL, manufactured by Sandoz Ltd., Switzerland) at a temperature of 60° C. for 15 min for coloring. The colored aluminum alloy, after washing with water, was treated in an aqueous solution containing 7 g/1 of nickel-base sealing agent at 100° C. for 20 min to obtain an anodized aluminum-base article with a deep color. The article was found to have an excellent corrosion resistance.

EXAMPLE 2

Example 1 was repeated in the same manner as described except that the first and second anodization treatments were performed for 20 min and 30 min, respectively, thereby to obtain a colored, anodized aluminum-base article. The lower, hard anodic oxide film had a thickness of about 20 μm and the upper, ordinary anodic oxide film before coloring treatment have a thickness of about 50 μm.

We claim:

1. A colored, anodized aluminum-base article comprising:

an aluminum-base substrate selected from the group consisting of aluminum and aluminum alloys;

a corrosion and weather-resistant inner aluminum oxide film formed on the surface of said substrate and having a thickness of between 30 and 150 microns and a Vicker's hardness number of at least about 330 Hv said inner film being uncolorable and having a metallic appearance; and an outer transparent and porous aluminum oxide film provided over the surface of said inner film and having a thickness of between 5 and 25 microns, a Vicker's hardness number of not greater than 270 Hv and a pore size between about 200 and 300 A;

a coloring agent deposited in a substantial portion of said pores by immersion in a coloring solution, said coloring agent imparting color to said article without destroying the transparent quality of said outer film;

said outer film having been formed by anodizing said substrate in a first electrolyte bath said bath consisting of a sulfuric acid solution using graphite as a counter-electrode at a controlled temperature between 20 and 40° C. at a constant direct current density;

said inner film having been formed under the outer film by anodizing said substrate in a second electrolyte bath, said second bath consisting of a sulfuric acid solution using graphite as a counter electrode at a controlled temperature not higher than 10° C.; said article having a deep metallic color by the combined effect of the color of said transparent outer film and the metallic appearance of said inner film showing through the transparent outer film.

2. The article of claim 1 wherein said inner film has a thickness between 50 and 70 μm and a Vicker's hardness number between about 350 and about 450 Hv and said outer film has a thickness between 10 and 20 μm and a Vicker's hardness number between about 150 and 250 Hv.

3. The article of claim 1 wherein said substrate comprises an aluminum-base alloy consisting essentially of 3.2–3.8% Mg, 2.8–3.2% Zn and aluminum, said percentages being by weight.

* * * * *